United States Patent [19]

Brown et al.

[11] Patent Number: 4,940,363

[45] Date of Patent: Jul. 10, 1990

[54] MINE ROOF SUPPORT ASSEMBLY

[75] Inventors: Stephen A. Brown, Cheltenham; Neville J. H. Sleigh, Gloucestershire, both of England

[73] Assignee: Meco Mining Equipment Limited, Tewkesbury, England

[21] Appl. No.: 437,803

[22] Filed: Nov. 17, 1989

[30] Foreign Application Priority Data

Sep. 21, 1989 [GB] United Kingdom ..... 8921333

[51] Int. Cl.[5] ..... E21D 23/04; E21D 15/44

[52] U.S. Cl. ..... 405/296; 405/291

[58] Field of Search ..... 405/291–296; 299/32, 33

[56] References Cited

U.S. PATENT DOCUMENTS

| | | | |
|---|---|---|---|
| 3,640,581 | 2/1972 | Rassmann et al. | 299/32 |
| 3,811,288 | 5/1974 | Wehner et al. | 405/296 |
| 3,915,500 | 10/1975 | Schlusener et al. | 299/32 |
| 4,462,637 | 7/1984 | Rafael et al. | 405/295 X |
| 4,571,127 | 2/1986 | Merten et al. | 299/33 X |

FOREIGN PATENT DOCUMENTS

| | | | |
|---|---|---|---|
| 3023282 | 1/1982 | Fed. Rep. of Germany | 405/296 |
| 0443996 | 12/1974 | U.S.S.R. | 405/296 |
| 2077832 | 12/1981 | United Kingdom . | |
| 2084231 | 4/1982 | United Kingdom | 405/292 |
| 2142075 | 1/1985 | United Kingdom . | |
| 2199068 | 6/1988 | United Kingdom | 405/296 |

*Primary Examiner*—Dennis L. Taylor

*Attorney, Agent, or Firm*—Young & Thompson

[57] ABSTRACT

A mine roof support assembly comprises a mine roof support having a first end adjacent to the mine face and a second end remote from the mine face, an advancing mechanism for advancing the roof support towards the mine face, and a base lifting mechanism. The base lifting mechanism includes two substantially parallel arm members pivotally connected to a base section of the mine roof support, and two lifting rams each of which acts between a respective arm member and the roof support. The lifting rams act on the roof support at a position which is nearer than the center of gravity of the roof support assembly to the second end of the roof support to pivot the roof support relative to a respective arm member and thereby lift the first end of the roof support clear of the ground. Also, an advancing ram of the advancing mechanism is connected to the arm members by an arrangement which provides some movement of the ram relative to the arm members in two mutually transverse directions.

10 Claims, 6 Drawing Sheets

MINE ROOF SUPPORT ASSEMBLY

BACKGROUND TO THE INVENTION

This invention relates to a mine roof support assembly, and in particular to a mine roof support assembly which incorporates a base lifting mechanism.

Known base lifting mechanisms for mine roof supports include lifting rams which apply a lifting force to the roof support on that side of the centre of gravity thereof which is in use adjacent to the mine face, i.e. on that side of the centre of gravity of the roof support which is remote from the goaf side of the roof support. These known mechanisms suffer from a number of drawbacks. First, the lifting rams of the base lifting mechanisms occupy space which could more usefully provide a wider travelway through the roof support assembly. Second, these known lifting rams, particularly when used in conjunction with roof supports designed for thin seam operations, are located so as to make it virtually impossible to provide all hydraulic controls for the roof support assembly in a single unit, with the result that it is common practice to separate these controls into two parts. This is far from ideal as it can add to the cost, and is ergonomically less efficient for an operator.

SUMMARY OF THE INVENTION

In seeking to mitigate these drawbacks, the present invention provides a mine roof support assembly comprising a mine roof support having a first end in use adjacent to the mine face and a second end in use remote from the mine face, an advancing mechanism for advancing the roof support towards the mine face, and a base lifting mechanism including an arm member pivotally connected to a base section of the mine roof support at a position adjacent to the second end thereof, and a lifting ram which acts, either directly or indirectly, between the arm member and the roof support, the lifting ram acting on the roof support assembly at a position which is nearer than the centre of gravity of the roof support to the second end of the roof support to pivot the roof support relative to the arm member and thereby lift the first end of the roof support clear of the ground.

The lifting ram(s) of a mine roof support assembly according to the invention is/are therefore nearer to the goaf side of the roof support than in hitherto known designs and this makes it possible to provide a wider travelway through a row of roof support assemblies, and also makes it possible to provide all hydraulic controls for the roof support assembly in a common unit.

Preferably, the advancing mechanism comprises a relay bar arrangement and an advancing ram operatively connected between the relay bar arrangement and the arm member or the base section of the roof support. In this case, advantageously, one end of the relay bar arrangement is pivotally connected to one end of the advancing ram and the other end of the relay bar arrangement is provided with means for attachment to an abutment, for example a conveyor assembly.

Preferably, the base lifting mechanism includes two substantially parallel arm members pivotally connected to the base section of the mine roof support at positions adjacent to the second end of the roof support, and two lifting rams each of which acts, either directly or indirectly, between a respective arm member and the roof support.

In that case, preferably the advancing ram is connected to the arm members by an arrangement which provides for some movement of the ram relative to the arms in two mutually transverse directions. In this case the arrangement may comprise two rotatable members each disposed relative to a respective arm member, and a cross member, pivotally connected at opposing ends thereof to the rotatable members, the axis of rotation of each rotatable member, the axis about which the arm members pivot, and the axes about which the cross member pivots being each transverse to the other two. The advancing ram may be pivotally connected to the cross member.

Alternatively, the arrangement may comprise a cage, which is mounted about the ram, and which is connected at opposing ends thereof to the arm members for movement relative to each arm member about a first substantially vertical axis and a second substantially horizontal axis substantially parallel with the pivot axis between the arm member and the roof support.

Preferably, the roof support has a base section which comprises two pontoon members to each of which one of said arm members is pivotally connected.

The invention will now be more particularly described, by way of example, with reference to the accompanying drawings.

DESCRIPTION OF THE PREFERRED EMBODIMENTS

Figure 1:
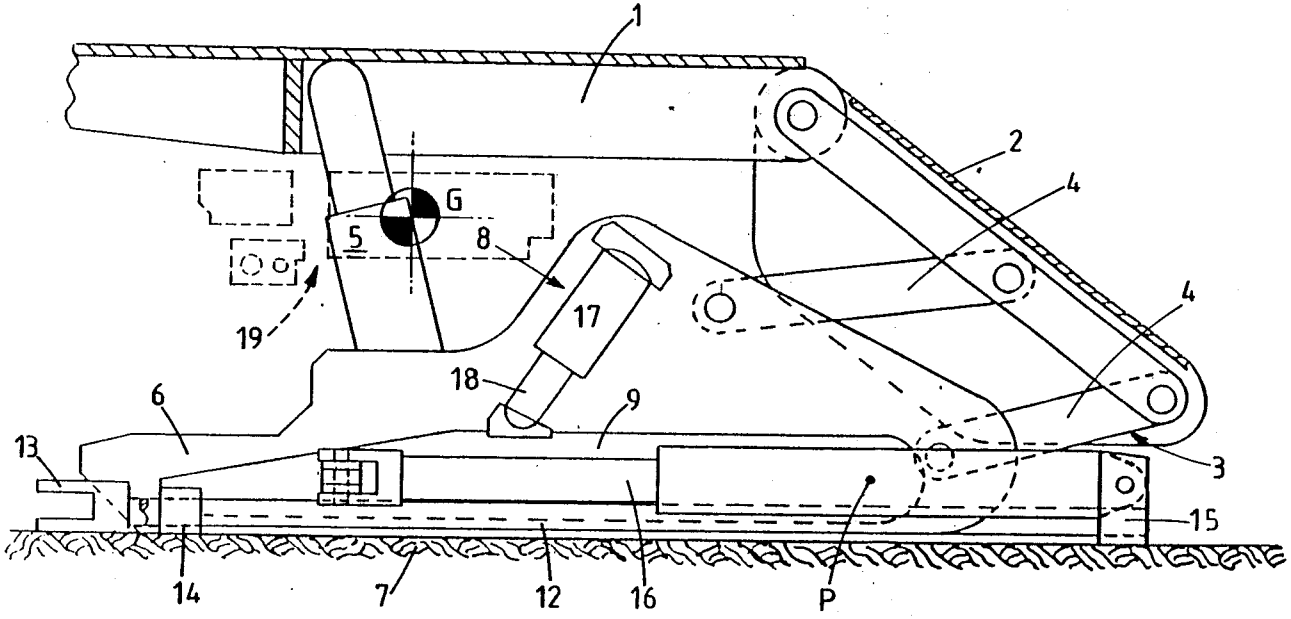
FIG. 1 is a side view of one embodiment of a mine roof support assembly made in accordance with the present invention.
Figure 2:
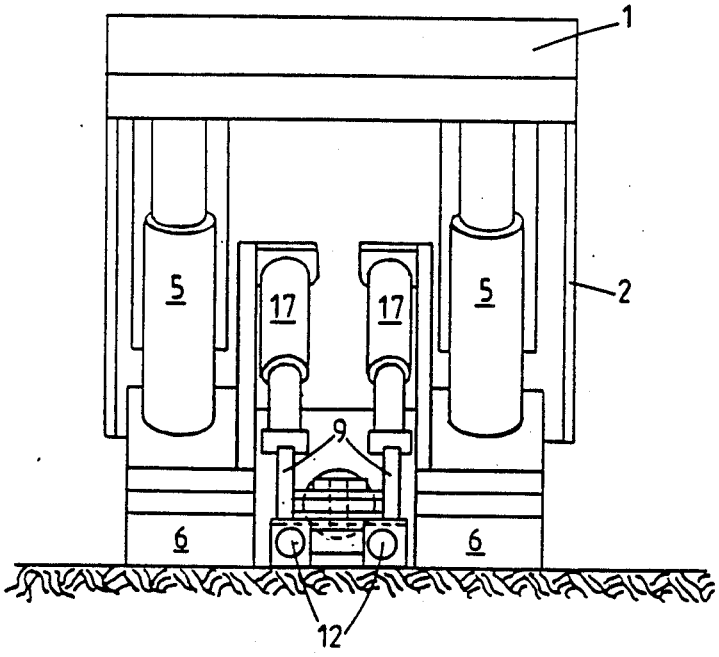
FIG. 2 is an end view of the roof support assembly shown in FIG. 1.
Figure 3:
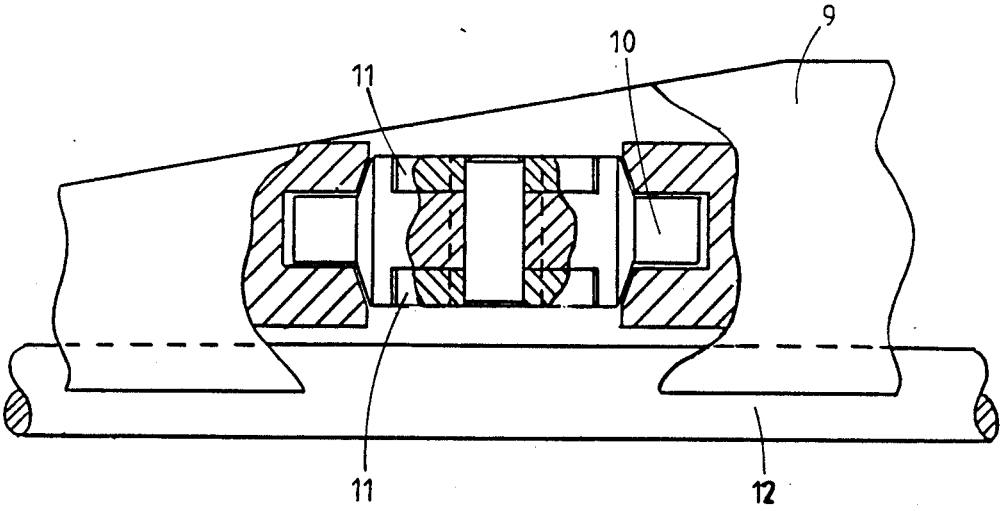
FIG. 3 is an enlarged view of the advancing ram mounting of the roof support assembly shown in FIG. 1, with the ram omitted for clarity.
Figure 4:
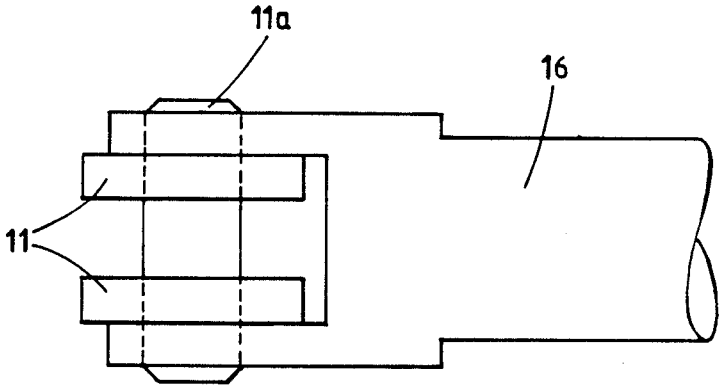
FIG. 4 is a view, also enlarged, showing the connection between the ram and the cross members of FIG. 3.

Referring now to the drawings, the mine roof support assembly shown therein includes a roof support comprising a canopy 1, a shield section 2, a lemniscate linkage arrangement 3, a base section which comprises two pontoon members 6, and two hydraulic props 5.

The shield section 2 is pivotally connected at one end to one end of the canopy, and the lemniscate linkage arrangement 3, which includes four links 4, is pivotally connected at one end to the other end of the shield section, and at the other end to the pontoon members 6.

The roof support assembly also comprises an advancing mechanism 7 disposed in the space between the two pontoon members 6, and a base lifting mechanism 8, which includes two longitudinally extending arm members 9, each of which is pivotally connected at one end thereof (about pivot P) to a respective pontoon member 6 and at a position adjacent to or near to the end of the roof support remote from the mine face. The advancing mechanism 7 comprises two rotatable members 10, two cross members 11, a relay bar arrangement, two guide blocks 14, a mounting hook 13, and an advancing ram 16.

Each of the members 10 is rotatably mounted with respect to one of the longitudinal extending arm members 9 at the end of said arm member remote from the pivotal connection P, and the cross members 11 are pivotally mounted at opposing ends thereof to the rotatable members 10. The axis of rotation of each rotatable member 10 is substantially parallel to the longitudinal extent of its respective arm member, and the pivot axes of the cross members 11 are substantially vertical.

The relay bar arrangement has two juxtaposed elongate members 12, which extend longitudinally through the roof support assembly. The guide blocks 14 are secured to the two longitudinally extending arm members 9, respectively, and the elongate members 12 extend through respective guide blocks. The mounting hook 13 is mounted on one end of the relay bar arrangement so as to enable the advancing mechanism 7 to be connected to an abutment means (not shown), for example a mine conveyor assembly. The advancing ram 16 is pivotally connected at one end to the cross members 11 by a pin 11*a* and at the other end to the end of the relay bar arrangement remote from the abutment means.

The arm members 9, rotatable members 10 and cross members 11 are mounted so that:

(a) the axes of rotation of the rotatable members;
(b) the axis about which the arm members pivot; and
(c) the axes about which the cross members pivot; are each transverse to the other two.

The elongate members 12 are secured in a block mounting 15 at their ends remote from the mounting hook 13. The advancing ram 16 is pivotally secured to the block mounting 15 so as to effect its mounting to the relay bar arrangement.

The base lifting mechanism 8 also includes two hydraulic rams 17 mounted one on each pontoon, and arranged so that the pistons 18 thereof act against a respective arm member 9. The rams 17 are each mounted on a respective pontoon 6 on the goaf side of the centre of gravity, shown at G in FIG. 1 of the roof support assembly. In other words each ram 17 acts on its respective pontoon 6 at a position on that side of a vertical plane, which passes through the centre of gravity G of the roof support assembly and which is parallel with pivot axis P, remote from the mine face. Indeed, as is preferred, the rams 17 are located entirely on that side of said vertical plane remote from the mine face. As compared with known base lifting mechanisms, the rams 17 are therefore much nearer to the goaf side of the roof support. This provides a wider travelway through a series of supports arranged side-by-side alongside a mine conveyor assembly. Also, the position of the rams 17 enables all hydraulic controls for the roof support to be provided in a single unit shown in FIG. 1 in broken lines at 19.

In operation so as to effect base lifting of the roof support the supporting load to the mine is removed, and the hydraulic rams 17 are operated to apply a lifting force to the pontoons 6. The arm members 9 react with the mine floor and the pontoons 6 pivot with respect to the arm members 9 about pivot axis P, and the section (toe portion) of the roof support near the mine face is lifted clear of the mine floor.

The advancing ram 16 can now be activated, while the mine conveyor assembly is pinned by other roof supports on either side, so as to draw the roof support across the mine floor, and so advance the support. The roof support is then allowed to settle to the mine floor, and the supporting load is reapplied.

The operation and set up of the rams 17 of the base lifting mechanism may be such that the rams operate independently, and thereby provide independent lifting of the pontoons 6. The rotatable members 10, cross members 11 and pivotal connection between the advancing ram 16 and the cross members 11 provides in effect a universal joint between the advancing ram 16 and the arm members 9, thus enabling the ram 16 to maintain an optimum centroid position relative to the roof support. Also, it should be noted that the pivotal connections between the arms 9 and respective pontoons 6, between the rotatable members 10 and the cross members 11, and between the ram 16 and the cross members 11 are all relatively loose to provide for a degree of lateral movement. This, together with the "universal joint" between the advancing ram 16 and the arm members 9, provides for the independent lifting of the pontoons 6, and also allows the pontoons 6 to settle on uneven mine floors.

The characteristics of the mounting for the advance ram, and in particular its response to the movement of the two pontoons, is more fully described in GB No. 2210093, the contents of which are included by way of reference.

Figure 5:
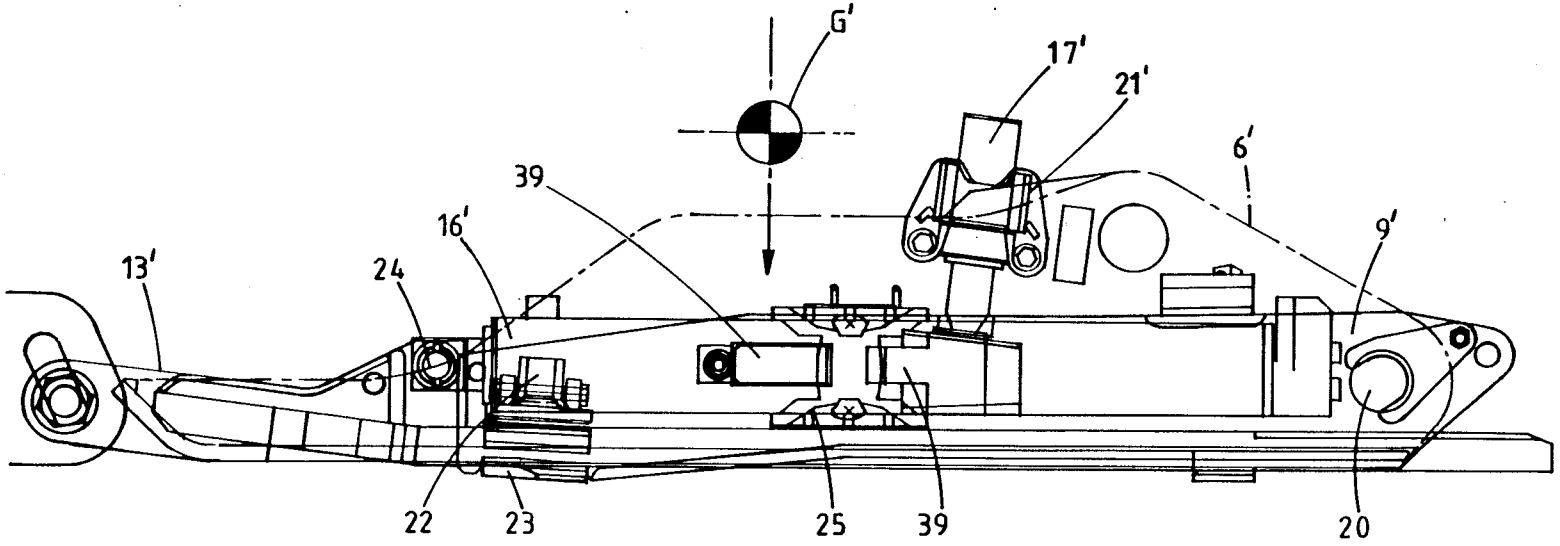
FIG. 5 is a side view of a modified advancing ram and relay bar assembly.
Figure 6:
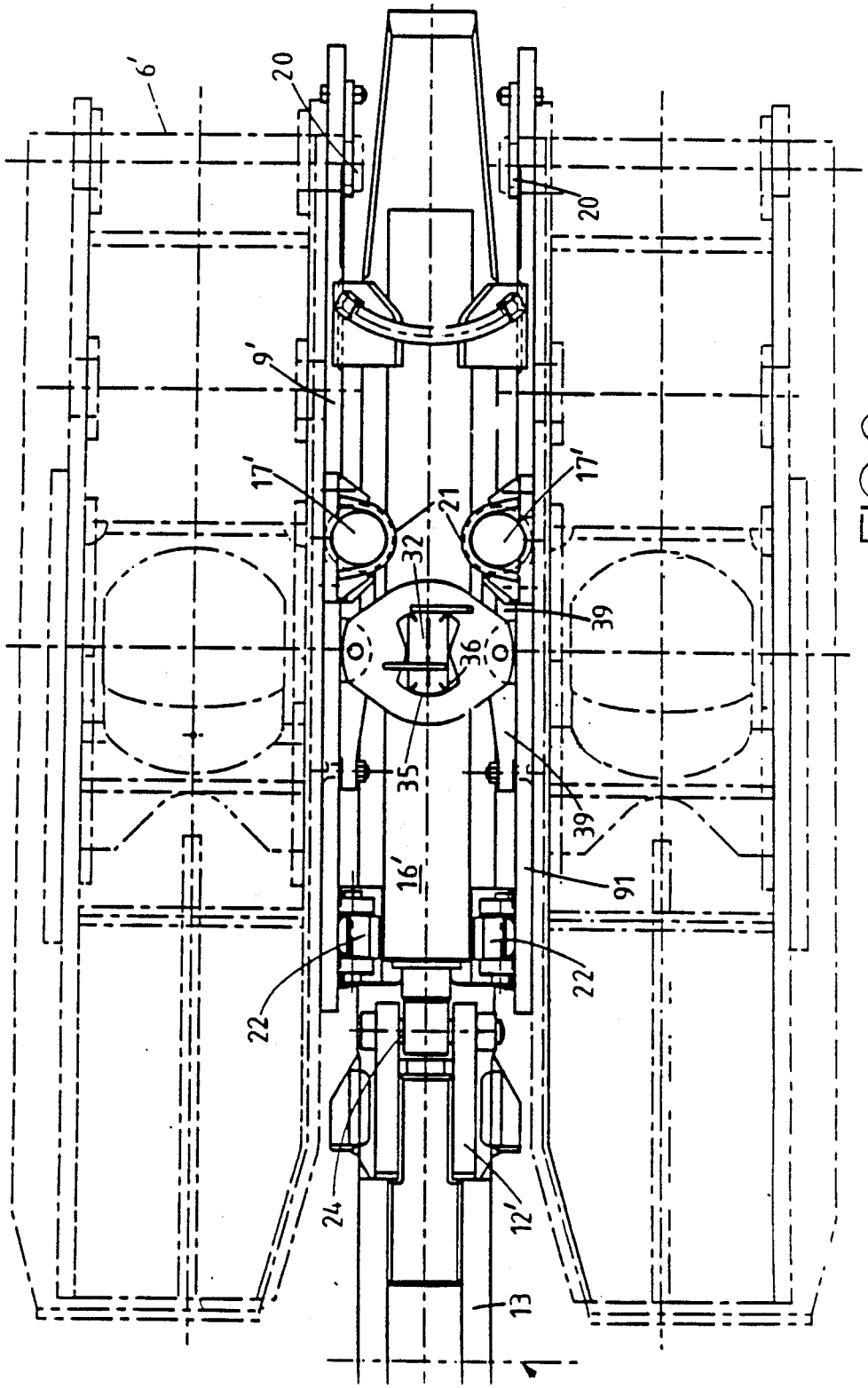
FIG. 6 is a plan view of the advancing ram and relay bar assembly of FIG. 5.
Figure 7:
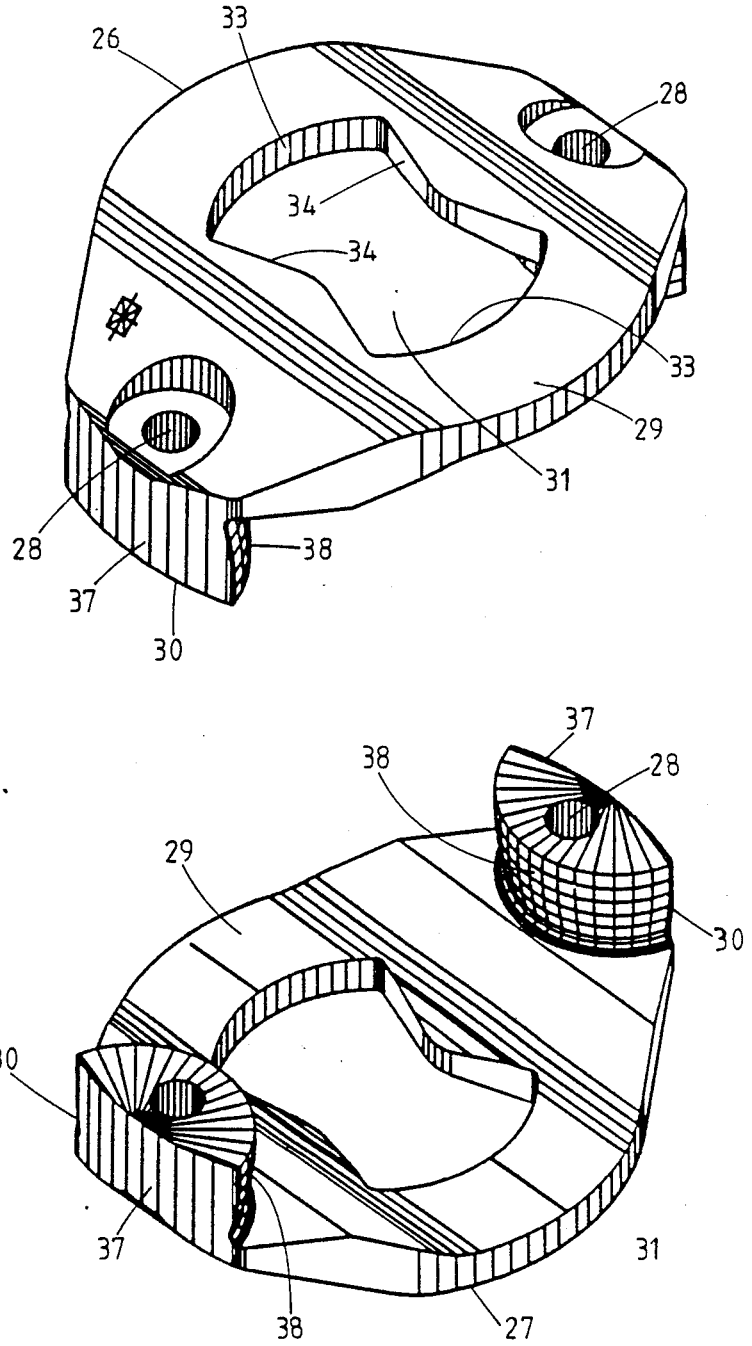
FIG. 7 is a perspective exploded view of the two parts of the cage of the assembly shown in FIGS. 5 and 6.

Referring now to FIGS. 5 to 7, there is shown therein a modified advancing ram and relay bar assembly for use with the mine roof support of FIG. 1.

In the assembly shown in FIGS. 5 to 7, the pontoons of the base section of the roof support are shown in broken lines at 6'. The longitudinally extending arm members are shown at 9', and are each pivotally connected at one end to a respective pontoon 6' by a hinge pin 20. The hydraulic lifting rams are shown at 17' and are mounted in ram support brackets 21 attached to respective pontoons 6'. The pistons of the rams 17' bear against abutments fixed to respective arm members 9'. Again the rams 17' are each mounted on a respective pontoon 9' on the goaf side of the centre of gravity G' (see FIG. 5) of the roof support, but in this case the rams 17' are, by way of example, arranged so that their axes are nearer to being vertical than in the case of the rams 17 of the embodiment shown in FIGS. 1 to 4.

The relay bar arrangement of FIGS. 5 to 7 comprises a single relay bar 12' having a mounting hook 13' at one end. The end of each arm member 9' nearest to the mine face supports two pads 22 and 23. The pad 22 makes contact with the upper surface of the relay bar 12', and the pad 23 makes contact with the lower surface of the relay bar 12'. These pads 22 and 23 therefore serve to guide the relay bar 12' relative to the arm members 9'.

The advancing ram of the assembly of FIGS. 5 to 7 is shown at 16'. In this case, the piston of the advancing ram 16' is connected to the relay bar 12' by a pin 24, and the cylinder of the advancing ram is connected to the two arm members 9' by a cage 25.

The cage 25 is best shown in FIG. 7, and comprises upper and lower cage parts 26 and 27, respectively, which are secured together, with the cylinder of the ram 16' passing therebetween, by bolts extending through holes 28. Each cage part 26, 27 has a main body part 29 and a bearing portion 30 at each of two opposite ends of the body part 29. The main body part 29 has a central aperture 31 which receives a lug 32 (see FIG. 6) secured to the cylinder of the ram 16'. The aperture 31 has two arcuate ends 33, and two inwardly arched sides 34. The lug 32 also has two arcuate ends 35, but two rectilinear sides 36 spaced from one another by a distance slightly less than the minimum width between the sides 34 of the aperture 31. It is therefore possible for the cage 25 and ram 16' to pivot to a limited extent relative to one another about a substantially vertical axis.

Each bearing portion 30 has outer and inner radiused walls 37 and 38, respectively, the radius of the inner wall 38 being much less than the radius of the outer wall 37. The inner wall 38 also curves inwards slightly from the free end of the bearing portion 30 to its junction with its main body part 29.

Each arm member 9' is fitted with two cage retainers 39. These retainers 39 have arcuate retaining portions which loosely make contact with the inner walls 38 of the bearing portions 30 of the cage 25 so as to permit each bearing portion 30 to rock within its respective retainers 39 about a substantially vertical axis and the pivot through a very limited angle of about ±3° from the position shown in FIG. 5 about a horizontal axis which is parallel with the pivot axis between the arm member 9' and its respective pontoon 6'.

The connections between on the one hand the ram 16' and the cage 25, and on the other hand between the cage 25 and the arm members 9' thus enable the ram 16' to maintain an optimum centroid position relative to the roof support, and also provide for independent lifting of the pontoons 6', and allow the pontoons 6', to settle on uneven mine floors.

The operations of lifting and advancing the roof support with the assembly shown in FIGS. 5 to 7 are similar to those described previously connection with the embodiment of FIGS. 1 to 4.

The above embodiments of a mine roof support assembly are given by way of example only and various other modifications will be apparent to persons skilled in the art without departing from the scope of the invention defined by the appended claims. For example, the base lifting mechanism may have only a single arm member and/or only a single lifting ram, and the advancing ram may be connected between the relay bar arrangement and the base section of the roof support instead of between the relay bar arrangement and the arm member(s).

What is claimed is:

1. A mine roof support assembly comprising a mine roof support having a first end in use adjacent to the mine face and a second end in use remote from the mine face, an advancing mechanism for advancing the roof support towards the mine face, and a base lifting mechanism including an arm member pivotally connected to a base section of the mine roof support at a position adjacent to the second end of the mine roof support, and a lifting ram which acts between the arm member and the roof support, the lifting ram acting on the roof support at a position which is nearer than the centre of gravity of the roof support assembly to the second end of the roof support to pivot the roof support relative to the arm member and thereby lift the first end of the roof support clear of the ground.

2. A roof support assembly as claimed in claim 1, wherein the advancing mechanism comprises a relay bar arrangement and an advancing ram operatively connected between the relay bar arrangement and one of a group consisting of the arm member and the base section of the roof support.

3. A roof support assembly as claimed in claim 2, wherein one end of the relay bar arrangement is pivotally connected to one end of the advancing ram and the other end of the relay bar arrangement is provided with means for attachment to an abutment.

4. A roof support assembly as claimed in claim 1, wherein the base lifting mechanism includes two substantially parallel arm members pivotally connected to the base section of the mine roof support at positions adjacent to the second end of the roof support, and two lifting rams each of which acts between a respective arm member and the roof support.

5. A roof support assembly as claimed in claim 4, wherein the advancing ram is connected to the arm members by an arrangement which provides for some movement of the ram relative to the arm members in two mutually transverse directions.

6. A roof support assembly as claimed in claim 5, wherein the arrangement comprises two rotatable members each disposed relative to a respective arm member, and a cross member, pivotally connected at opposing ends thereof to the rotatable members, the axis of rotation of each rotatable member, the axis about which the arm members pivot, and the axes about which the cross members pivot being each transverse to the other two.

7. A roof support assembly as claimed in claim 6, wherein the advancing ram is pivotally connected to the cross member.

8. A roof support assembly as claimed in claim 5, wherein the arrangement comprises a cage, which is mounted about the ram, and which is connected at opposing ends thereof to the arm members for movement relative to each arm member about a first substantially vertical axis and a second substantially horizontal axis substantially parallel with the pivot axis between the arm member and the roof support.

9. A roof support assembly as claimed in claim 1, wherein the roof support comprises two pontoon members to each of which one of said arm members is pivotally connected.

10. A mine roof support assembly as claimed in claim 1, wherein the lifting ram is located entirely on that side of the centre of gravity of the roof support assembly adjacent to the second end of the roof support.

* * * * *